US008174309B2

(12) United States Patent
Yoshino et al.

(10) Patent No.: US 8,174,309 B2
(45) Date of Patent: May 8, 2012

(54) REFERENCE VOLTAGE CIRCUIT

(75) Inventors: Hideo Yoshino, Chiba (JP); Takashi Imura, Chiba (JP)

(73) Assignee: Seiko Instruments Inc., Chiba (JP)

( * ) Notice: Subject to any disclaimer, the term of this patent is extended or adjusted under 35 U.S.C. 154(b) by 85 days.

(21) Appl. No.: 12/888,799

(22) Filed: Sep. 23, 2010

(65) Prior Publication Data

US 2011/0074496 A1 Mar. 31, 2011

(30) Foreign Application Priority Data

Sep. 25, 2009 (JP) ..... 2009-221235
Aug. 11, 2010 (JP) ..... 2010-180567

(51) Int. Cl.
*G05F 1/10* (2006.01)

(52) U.S. Cl. ..... 327/541; 327/543

(58) Field of Classification Search ..... 323/315; 327/512, 534, 535, 537, 538, 540, 541, 543
See application file for complete search history.

(56) References Cited

U.S. PATENT DOCUMENTS 6,133,718 A * 10/2000 Calafato et al. ..... 323/312
7,479,821 B2 * 1/2009 Imura ..... 327/538
7,719,346 B2 * 5/2010 Imura ..... 327/538

FOREIGN PATENT DOCUMENTS

JP 08-335122 A 12/1996
JP 11-134051 A 5/1999

* cited by examiner

*Primary Examiner* — Jeffrey Zweizig
(74) *Attorney, Agent, or Firm* — Brinks Hofer Gilson & Lione

(57) ABSTRACT

Provided is a reference voltage circuit in which a temperature characteristic of a reference voltage is excellent and a circuit scale is small. In the reference voltage circuit, for example, a temperature correction circuit separated from the reference voltage circuit is not used and a difference voltage between threshold voltages of two E-type NMOS transistors (14 and 15) is added to a threshold voltage of a D-type NMOS transistor to generate a reference voltage (Vref). Therefore, the influence of the D-type NMOS transistor on the reference voltage (Vref), which is a degradation factor of the temperature characteristic of the reference voltage (Vref), may be reduced to suppress a change in tilt and curve of the reference voltage (Vref) with respect to a temperature.

18 Claims, 9 Drawing Sheets

REFERENCE VOLTAGE CIRCUIT

RELATED APPLICATIONS

This application claims priority under 35 U.S.C. §119 to Japanese Patent Application Nos. 2009-221235 filed on Sep. 25, 2009 and 2010-180567 filed on Aug. 11, 2010, the entire contents of which are hereby incorporated by reference.

BACKGROUND OF THE INVENTION

1. Field of the Invention

The present invention relates to a reference voltage circuit using an enhancement type NMOS transistor (E-type NMOS transistor) and a depletion type NMOS transistor (D-type NMOS transistor).

2. Description of the Related Art

In recent years, for example, in an integrated circuit (IC) for protecting a lithium battery, the lithium battery is required to be charged in a temperature range in which the lithium battery is useable, that is, in a range up to an over-charge detection voltage of the lithium battery which is specified by the Electrical Appliance and Material Safety Law in Japan. In a case where a temperature characteristic of the overcharge detection voltage is poor, when the overcharge detection voltage becomes lower because of a change in temperature, the lithium battery is not completely charged, to thereby shorten an operating time of an electronic device using the lithium battery. When the overcharge detection voltage becomes higher, a battery voltage of the lithium battery exceeds the overcharge detection voltage, and hence fire accidents are highly likely to occur. Therefore, an IC in which the temperature characteristic of the overcharge detection voltage is excellent is desired. In other words, the overcharge detection voltage is a reference voltage output from a reference voltage circuit included in the IC, and hence an IC in which the temperature characteristic of the reference voltage is excellent is desired.

Even in a case of an IC for another use, when the temperature characteristic of the reference voltage is poor, it is likely to cause a defect, for example, an erroneous operation because of the change in temperature. Therefore, an IC in which the temperature characteristic of the reference voltage is excellent is also desired.

A conventional reference voltage circuit is described. FIG. 8 illustrates the conventional reference voltage circuit. FIG. 9 illustrates a conventional relationship between a reference voltage and a temperature.

When a gate-source voltage of a D-type NMOS transistor 91 is denoted by VGD, a threshold voltage thereof is denoted by VTD, and a K-value (drive capability) thereof is denoted by KD, a drain current ID is expressed by the following Expression (1).

$$ID=KD\cdot(VGD-VTD)^2 \tag{1}$$

A gate of the D-type NMOS transistor 91 is connected to a source thereof, and hence VGD=0. Therefore, the following Expression (2) holds.

$$ID=KD\cdot(0-VTD)^2=KD\cdot(|VTD|)^2 \tag{2}$$

When a gate-source voltage of an E-type NMOS transistor 92 is denoted by VGE, a threshold voltage thereof is denoted by VTE, and a K-value thereof is denoted by KE, a drain current IE is expressed by the following Expression (3).

$$IE=KE\cdot(VGE-VTE)^2 \tag{3}$$

The same drain current flows into the D-type NMOS transistor 91 and the E-type NMOS transistor 92, and hence ID=IE. Therefore, the following Expression (4) holds. From Expression (4), the following Expression (5) holds.

$$ID=IE=KD\cdot(|VTD|)^2=KE\cdot(VGE-VTE)^2 \tag{4}$$

$$VGE=VTE+(KD/KE)^{1/2}\cdot|VTD| \tag{5}$$

The E-type NMOS transistor 92 is saturation-connected, and hence a gate voltage is equal to a drain voltage. The drain voltage corresponds to a reference voltage Vref. Therefore, the reference voltage Vref is expressed by the following Expression (6).

$$VGE=V\mathrm{ref}=VTE+(KD/KE)^{1/2}\cdot|VTD| \tag{6}$$

The K-values of the D-type NMOS transistor 91 and the E-type NMOS transistor 92 are circuit-designed as appropriate so that the following Expression (7) holds in a case where $(KD/KE)^{1/2}=\alpha$ to improve the temperature characteristic of the reference voltage Vref, that is, to suppress a change in tilt of the reference voltage Vref with respect to a temperature.

$$\frac{dVref}{dT_{T=25^\circ C.}}=\frac{dVTE}{dT_{T=25^\circ C.}}+\frac{d\alpha|VTD|}{dT_{T=25^\circ C.}}=0 \tag{7}$$

However, as indicated by a solid line 201 of FIG. 9, the reference voltage Vref curves in a substantially quadric manner with respect to a temperature. In other words, the following Expression (8) does not become zero.

$$\frac{d^2Vref}{dT^2}=\frac{d^2VTE}{dT^2}+\frac{d^2\alpha|VTD|}{dT^2} \tag{8}$$

When the IC including the reference voltage circuit is in mass production, threshold voltages vary because of various factors. It has been known that a variation in threshold voltage of the D-type NMOS transistor 91 is larger than a variation in threshold voltage of the E-type NMOS transistor 92. That is, the first term and second term of the right side of Expression (7) vary, and hence Expression (7) does not hold. Therefore, as indicated by a dotted line 202 and a broken line 203 which are illustrated in FIG. 9, the reference voltage changes with respect to a temperature (see, for example, Japanese Patent Application Laid-open No. Hei 08-335122 (FIG. 2)).

In order to solve the problem described above, there has been proposed a technology in which a temperature correction circuit for the reference voltage Vref output from the reference voltage circuit is added to improve the temperature characteristic of the reference voltage Vref (see, for example, Japanese Patent Application Laid-open No. Hei 11-134051 (FIG. 1)).

When the technology disclosed in Japanese Patent Application Laid-open No. Hei 11-134051 is employed, the temperature characteristic of the reference voltage Vref is improved. However, the temperature correction circuit for the reference voltage Vref output from the reference voltage circuit is added separate from the reference voltage circuit, and hence a circuit scale is increased by the addition.

SUMMARY OF THE INVENTION

The present invention has been made in view of the above-mentioned problems. An object of the present invention is to provide a reference voltage circuit in which a temperature characteristic of a reference voltage is excellent and a circuit scale is small.

In order to solve the above-mentioned problems, the present invention provides a reference voltage circuit, including: a first depletion type NMOS transistor including: a gate connected to a first terminal; and a drain connected to a power supply terminal; a second depletion type NMOS transistor including: a gate connected to the gate of the first depletion type NMOS transistor; a source connected to a second terminal; and a drain connected to the power supply terminal; a first NMOS transistor including: a drain connected to the first terminal; and a source connected to a ground terminal; a second NMOS transistor including: a gate connected to a drain thereof, a gate of the first NMOS transistor, and the second terminal; and a source connected to a reference voltage output terminal, the second NMOS transistor having a threshold voltage lower than a threshold voltage of the first NMOS transistor; and a voltage generation circuit including a third depletion type NMOS transistor, for generating a reference voltage between the reference voltage output terminal and the ground terminal.

According to the reference voltage circuit in the present invention, for example, a temperature correction circuit separated from the reference voltage circuit is not used and a difference voltage between the threshold voltages of the two enhancement type NMOS transistors is added to a threshold voltage of a depletion type NMOS transistor to generate a reference voltage. Therefore, the influence of the depletion type NMOS transistor on the reference voltage, which is a degradation factor of a temperature characteristic of the reference voltage, may be reduced to suppress a change in tilt and curve of the reference voltage with respect to a temperature.

DETAILED DESCRIPTION OF THE PREFERRED EMBODIMENTS

Referring to the accompanying drawings, embodiments of the present invention are described below.

First Embodiment

Figure 1:
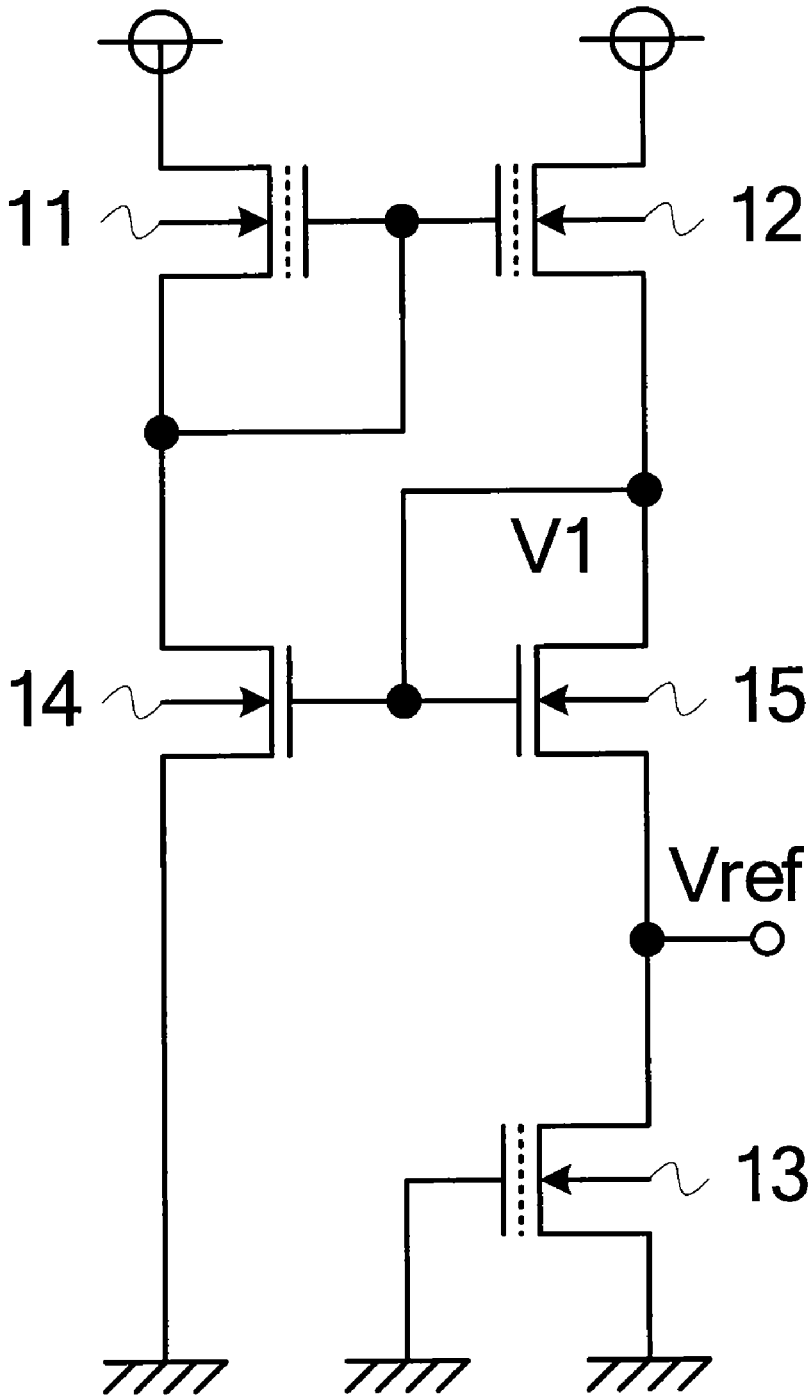
FIG. 1 is a circuit diagram illustrating a reference voltage circuit according to a first embodiment of the present invention.

A first embodiment of the present invention is described. FIG. 1 is a circuit diagram illustrating a reference voltage circuit according to the first embodiment of the prevent invention.

The reference voltage circuit includes depletion type NMOS transistors (D-type NMOS transistors) 11 to 13 and enhancement type NMOS transistors (E-type NMOS transistors) 14 and 15.

A gate of the D-type NMOS transistor 11 is connected to a source thereof, a gate of the D-type NMOS transistor 12, and a drain of the E-type NMOS transistor 14. A drain of the D-type NMOS transistor 11 is connected to a power supply terminal. A drain of the D-type NMOS transistor 12 is connected to the power supply terminal. A gate of the E-type NMOS transistor 15 is connected to a drain thereof, a gate of the E-type NMOS transistor 14, and a source of the D-type NMOS transistor 12. A source of the E-type NMOS transistor 15 is connected to a reference voltage output terminal. A source of the E-type NMOS transistor 14 is connected to a ground terminal. A gate and source of the D-type NMOS transistor 13 are connected to the ground terminal and a drain thereof is connected to the reference voltage output terminal.

The D-type NMOS transistors 11 to 13 have negative threshold voltages. The E-type NMOS transistors 14 and 15 have positive threshold voltages. The threshold voltage of the E-type NMOS transistor 15 is lower than the threshold voltage of the E-type NMOS transistor 14.

The D-type NMOS transistors 11 and 12 form a current output circuit, which is provided between the power supply terminals and the respective drains of the E-type NMOS transistors 14 and 15, and outputs currents from the source (the first terminal) of the D-type NMOS transistor 11 and the source (the second terminal) of the D-type NMOS transistor 12. The D-type NMOS transistor 13 forms a voltage generation circuit, which is provided between the reference voltage output terminal and the ground terminal, and generates a reference voltage at the reference voltage output terminal.

Next, an operation of the reference voltage circuit is described.

When a gate-source voltage of the D-type NMOS transistor 11 is denoted by VGD1, the threshold voltage thereof is denoted by VTD1, and a K-value (drive capability) thereof is denoted by KD1, a drain current ID1 is expressed by the following Expression (1A).

$$ID1 = KD1 \cdot (VGD1 - VTD1)^2 \tag{1A}$$

The gate of the D-type NMOS transistor 11 is connected to the source thereof, and hence VGD1=0. Therefore, the following Expression (2A) holds.

$$ID1 = KD1 \cdot (0 - VTD1)^2 = KD1 \cdot (|VTD1|)^2 \tag{2A}$$

When a gate-source voltage of the E-type NMOS transistor 14 is denoted by VGE1, the threshold voltage thereof is denoted by VTE1, and a K-value thereof is denoted by KE1, a drain current IE1 is expressed by the following Expression (3A).

$$IE1 = KE1 \cdot (VGE1 - VTE1)^2 \tag{3A}$$

Assume that each of a gate voltage and drain voltage of the E-type NMOS transistor 15 is a voltage V1 and a source voltage thereof is a reference voltage Vref. The same drain current flows into the D-type NMOS transistor 11 and the E-type NMOS transistor 14, and hence ID1=IE1. Therefore, VGE1=V1, and hence the following Expression (9) holds. From Expression (9), the following Expression (10) holds.

$$ID1=IE1=KD1\cdot(|VTD1|)^2=KE1\cdot(V1-VTE1)^2 \quad (9)$$

$$V1=VTE1+(KD1/KE1)^{1/2}\cdot|VTD1| \quad (10)$$

Assume that a gate-source voltage of the D-type NMOS transistor 13 is denoted by VGD2, the threshold voltage thereof is denoted by VTD2, and a K-value thereof is denoted by KD2. Assume that a gate-source voltage of the E-type NMOS transistor 15 is denoted by VGE2, the threshold voltage thereof is denoted by VTE2, and a K-value thereof is denoted by KE2. In such a case, the D-type NMOS transistor 12 operates to maintain the voltage V1 constant and the same drain current flows into the D-type NMOS transistor 13 and the E-type NMOS transistor 15. Therefore, a drain current ID2 of the D-type NMOS transistor 13 and a drain current IE2 of the E-type NMOS transistor 15 are equal to each other, and hence the following Expression (11) holds. From Expression (11), the following Expression (12) holds.

$$ID2=IE2=KD2\cdot(|VTD2|)^2=KE2\cdot(V1-V\text{ref}-VTE2)^2 \quad (11)$$

$$V\text{ref}=V1-VTE2-(KD2/KE2)^{1/2}\}\cdot|VTD2| \quad (12)$$

From Expressions (10) and (12), the following Expression (13) holds.

$$V\text{ref}=VTE1-VTE2+(KD1/KE1)^{1/2}\cdot|VTD1|-(KD2/KE2)^{1/2}\cdot|VTD2| \quad (13)$$

In this case, when the D-type NMOS transistors 11 and 13 are designed so that KD1=KD2 and VTD1=VTD2, the following Expression (14) holds from Expression (13).

$$V\text{ref}=VTE1-VTE2+\{(KD1/KE1)^{1/2}-(KD1/KE2)^{1/2}\cdot|VTD1| \quad (14)$$

The K-values of the D-type NMOS transistors 11 and 13 and the E-type NMOS transistors 14 and 15 are circuit-designed as appropriate so that the following Expression (15) holds in a case where $(KD1/KE1)^{1/2}-(KD1/KE2)^{1/2}=\beta$ to improve the temperature characteristic of the reference voltage Vref, that is, to suppress the change in tilt of the reference voltage Vref with respect to a temperature. When a general semiconductor manufacturing process is employed, 1>>β.

[Expression 15]

$$\frac{dVref}{dT_{T=25^\circ C.}}=\frac{dVTE1}{dT_{T=25^\circ C.}}-\frac{dVTE2}{dT_{T=25^\circ C.}}+\frac{d\beta\cdot|VTD1|}{dT_{T=25^\circ C.}}=0 \quad (15)$$

In this case, as in a conventional circuit, the reference voltage Vref curves in a substantially quadric manner with respect to a temperature. The curve is expressed by the following Expression (16).

$$\frac{d^2Vref}{dT^2}=\frac{d^2VTE1}{dT^2}-\frac{d^2VTE2}{dT^2}+\frac{d^2\beta|VTD1|}{dT^2} \quad (16)$$

A difference value between the first term and the second term of the right side of Expression (16) is small. When the general semiconductor manufacturing process is employed, 1>>β, and hence a value of the third term of the right side is also small. Therefore, a value of Expression (16) is also small, and hence the curve of the reference voltage Vref with respect to the temperature is suppressed. In this case, because β is small, even when |VTD1| which is the threshold voltage of the D-type NMOS transistors 11 and 13 varies, the reference voltage Vref is less likely to vary because |VTD1| is multiplied by β, which is a small value. In other words, because β is small, the influence of the D-type NMOS transistors 11 and 13 on the reference voltage Vref is small. The threshold voltages VTE1 and VTE2 of the E-type NMOS transistors 14 and 15 have the same variation, and hence (VTE1−VTE2) hardly changes. In other words, the influence of the E-type NMOS transistors 14 and 15 on the reference voltage Vref is also small.

The reference voltage circuit includes the two E-type NMOS transistors having the different threshold voltages and the two D-type NMOS transistors having the threshold voltages different from or equal to each other. Alternatively, the reference voltage circuit includes the two E-type NMOS transistors having the different threshold voltages and the single D-type NMOS transistor.

According to the reference voltage circuit, for example, a temperature correction circuit separated from the reference voltage circuit is not used and a difference voltage between the threshold voltages of the two E-type NMOS transistors 14 and 15 is added to a threshold voltage of the D-type NMOS transistor to generate the reference voltage Vref. Therefore, the influence of the D-type NMOS transistor on the reference voltage Vref, which is a degradation factor of a temperature characteristic of the reference voltage Vref, may be reduced to suppress a change in tilt and curve of the reference voltage Vref with respect to a temperature.

When a power supply is turned on, a current flows through the D-type NMOS transistor 11 because the gate and source thereof are connected to each other. Therefore, a current flows through the D-type NMOS transistor 12 current-mirror-connected to the D-type NMOS transistor 11. The current serves as an activation current for activating the reference voltage circuit and flows from the power supply terminal to the gates of the E-type NMOS transistors 14 and 15 to charge gate capacitors of the E-type NMOS transistors 14 and 15. When there are an operating point at which a desired current flows and an operating point at which a current is zero amperes, the reference voltage circuit stably operates at the former operating point because of the charging. In other words, when the power supply is turned on, the reference voltage circuit can be activated without fail without the use of an activation circuit.

Figure 2:
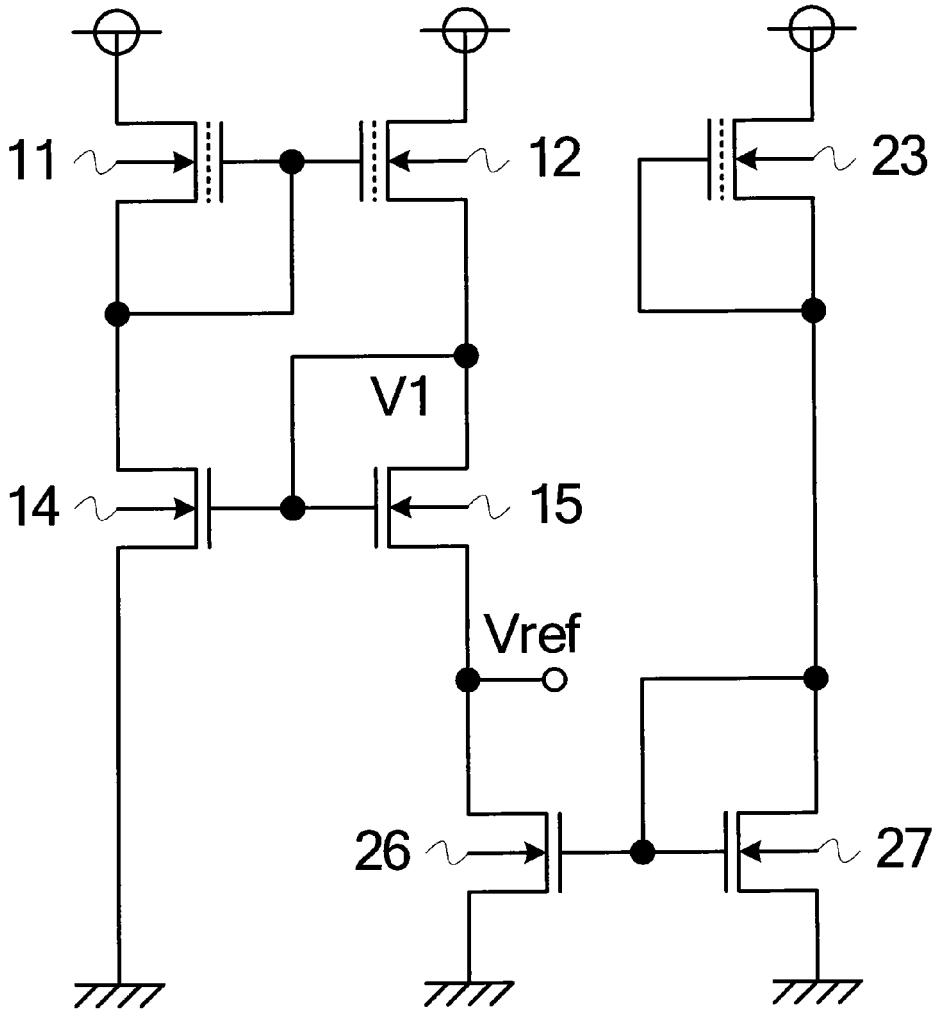
FIG. 2 is a circuit diagram illustrating an example of the reference voltage circuit according to the first embodiment of the present invention.

As illustrated in FIG. 2, as compared with FIG. 1, the D-type NMOS transistor 13 may be changed to an E-type NMOS transistor 26, and a D-type NMOS transistor 23 and an E-type NMOS transistor 27 may be added. In this case, a gate of the D-type NMOS transistor 23 is connected to a source thereof, a gate and drain of the E-type NMOS transistor 27, and a gate of the E-type NMOS transistor 26. A drain of the D-type NMOS transistor 23 is connected to the power supply terminal. A source of the E-type NMOS transistor 27 is connected to the ground terminal. A source of the E-type NMOS transistor 26 is connected to the ground terminal and a drain thereof is connected to the reference voltage output terminal. Therefore, as compared with the reference voltage circuit illustrated in FIG. 1, even when the reference voltage Vref is low, the transistor between the reference voltage output terminal and the ground terminal can be operated in the saturation region.

Figure 3:
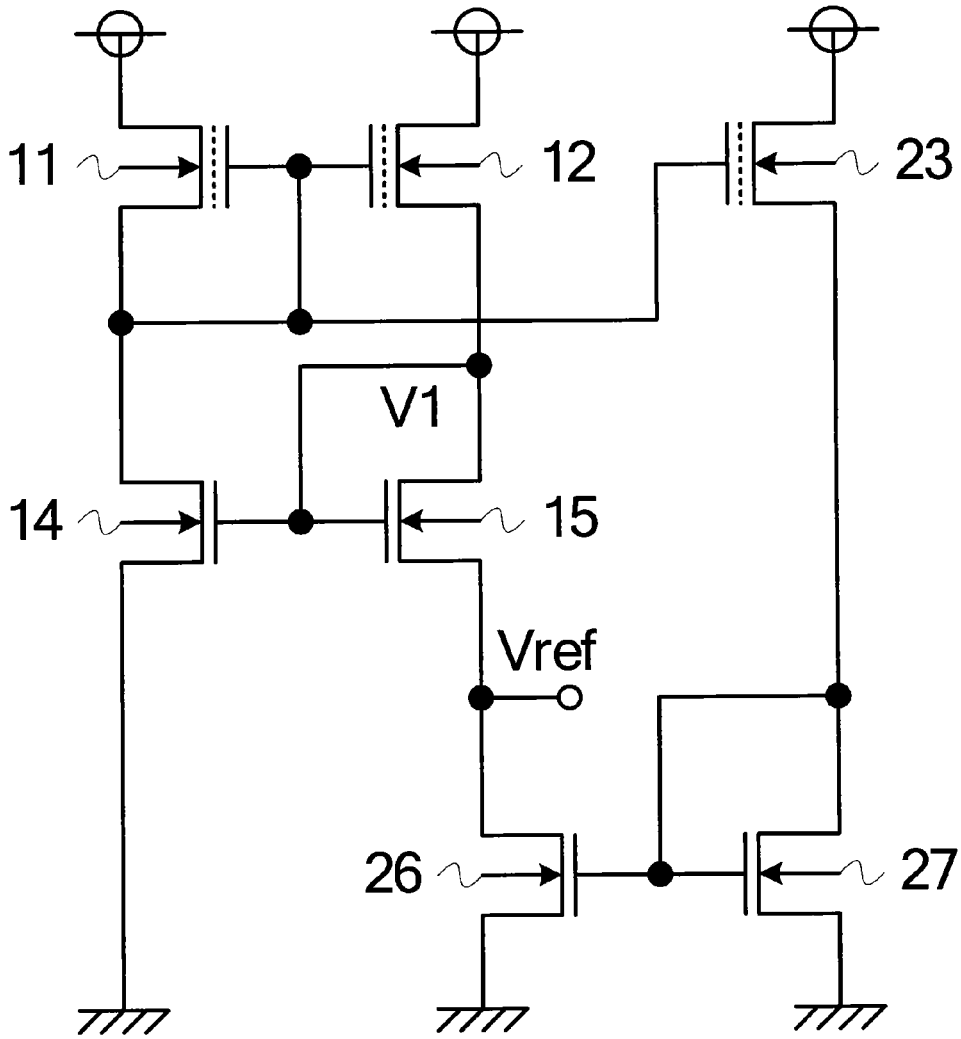
FIG. 3 is a circuit diagram illustrating another example of the reference voltage circuit according to the first embodiment of the present invention.

As illustrated in FIG. 3, as compared with FIG. 2, the gate of the D-type NMOS transistor 23 may be connected to the gate of the D-type NMOS transistor 11.

Figure 4:
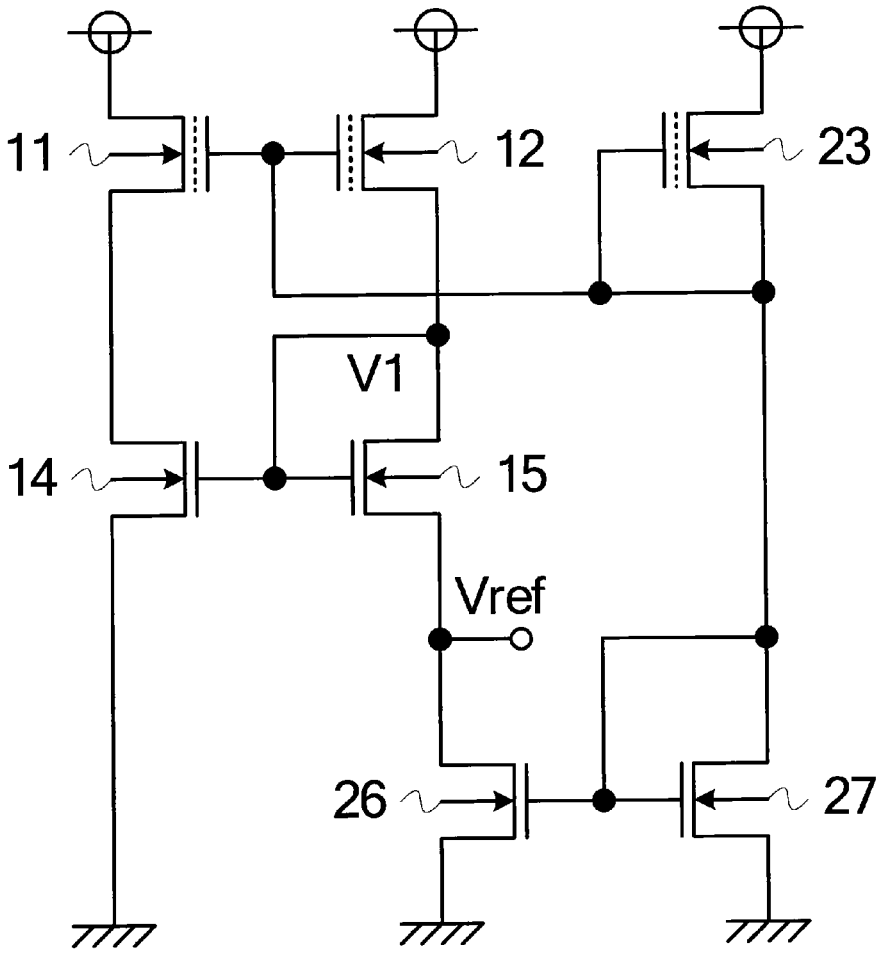
FIG. 4 is a circuit diagram illustrating another example of the reference voltage circuit according to the first embodiment of the present invention.

As illustrated in FIG. 4, as compared with FIG. 2, the gates of the D-type NMOS transistors 11 and 12 may be connected to the gate of the D-type NMOS transistor 23.

Figure 5:
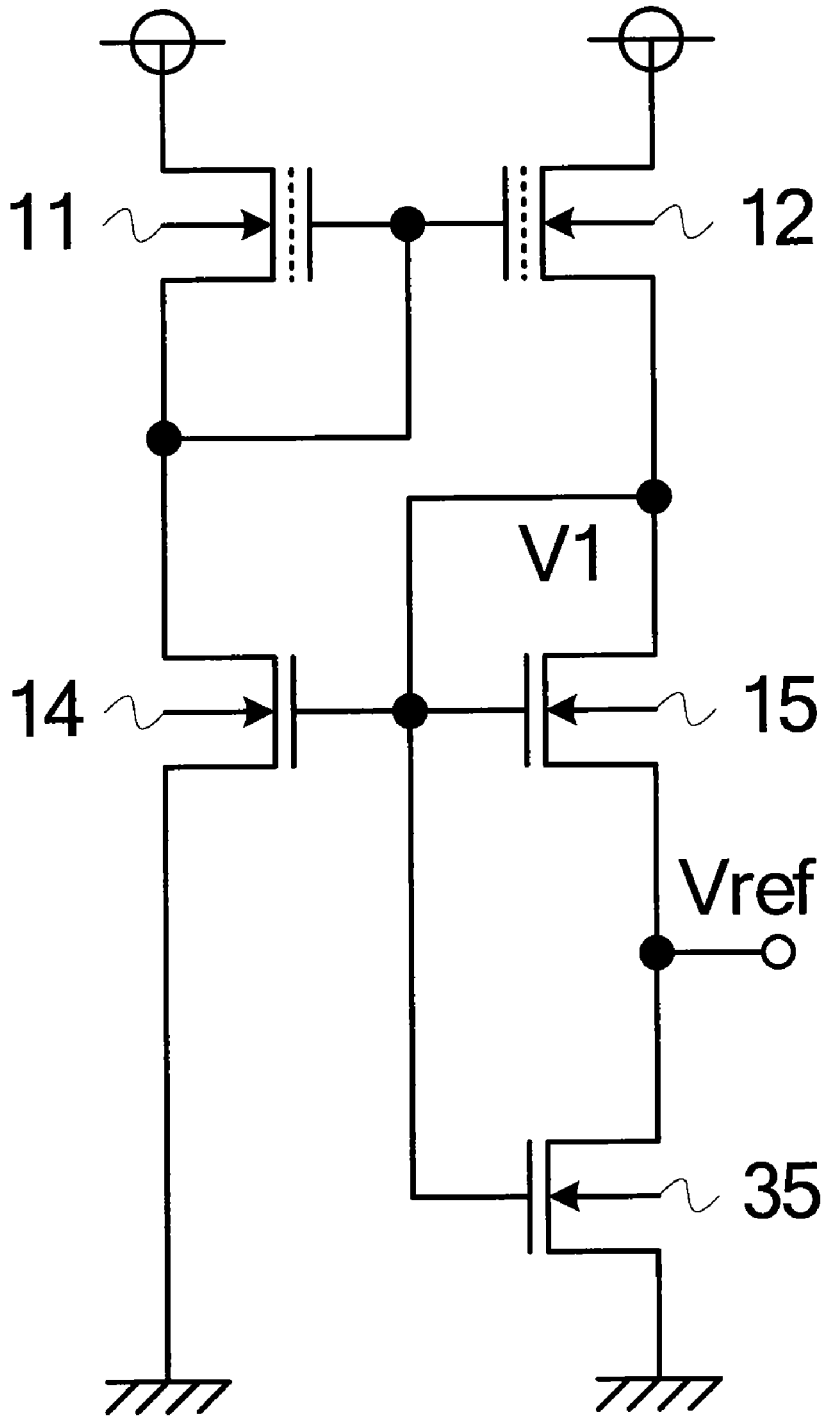
FIG. 5 is a circuit diagram illustrating another example of the reference voltage circuit according to the first embodiment of the present invention.

As illustrated in FIG. 5, as compared with FIG. 1, the D-type NMOS transistor 13 may be changed to an E-type NMOS transistor 35. In this case, a gate of the E-type NMOS transistor 35 is connected to the gates of the E-type NMOS transistors 14 and 15. A source of the E-type NMOS transistor 35 is connected to the ground terminal and a drain thereof is connected to the reference voltage output terminal. Therefore, as compared with the reference voltage circuit illustrated in FIG. 1, even when the reference voltage Vref is low, the transistor between the reference voltage output terminal and the ground terminal can be operated in the saturation region. As compared with the reference voltage circuits illustrated in FIGS. 2 to 4, a circuit scale is small, and hence current consumption reduces.

Figure 6:
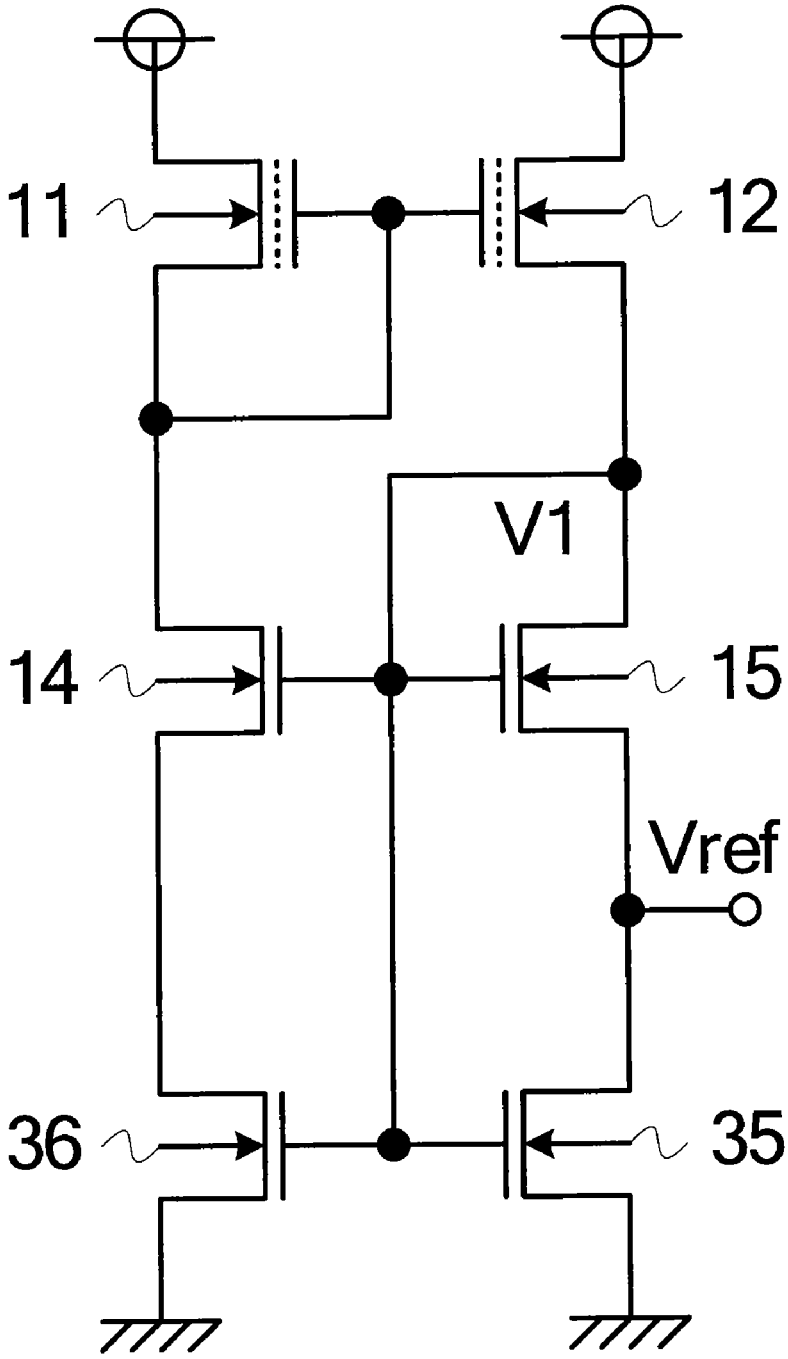
FIG. 6 is a circuit diagram illustrating another example of the reference voltage circuit according to the first embodiment of the present invention.

As illustrated in FIG. 6, as compared with FIG. 5, an E-type NMOS transistor 36 may be added. In this case, a gate of the E-type NMOS transistor 36 is connected to the gate of the E-type NMOS transistor 35. A source of the E-type NMOS transistor 36 is connected to the ground terminal and a drain thereof is connected to the source of the E-type NMOS transistor 14. Therefore, as compared with the reference voltage circuit illustrated in FIG. 5, a source voltage of the E-type NMOS transistor 14 varies in conjunction with the reference voltage Vref (source voltage of E-type NMOS transistor 15), and hence a current flowing through the reference voltage circuit can be controlled with higher precision.

The E-type NMOS transistor 15 may be changed to a D-type NMOS transistor. In such a case, the reference voltage Vref easily increases, and hence the transistor between the reference voltage output terminal and the ground terminal is easily operated in the saturation region.

Second Embodiment

Figure 7:
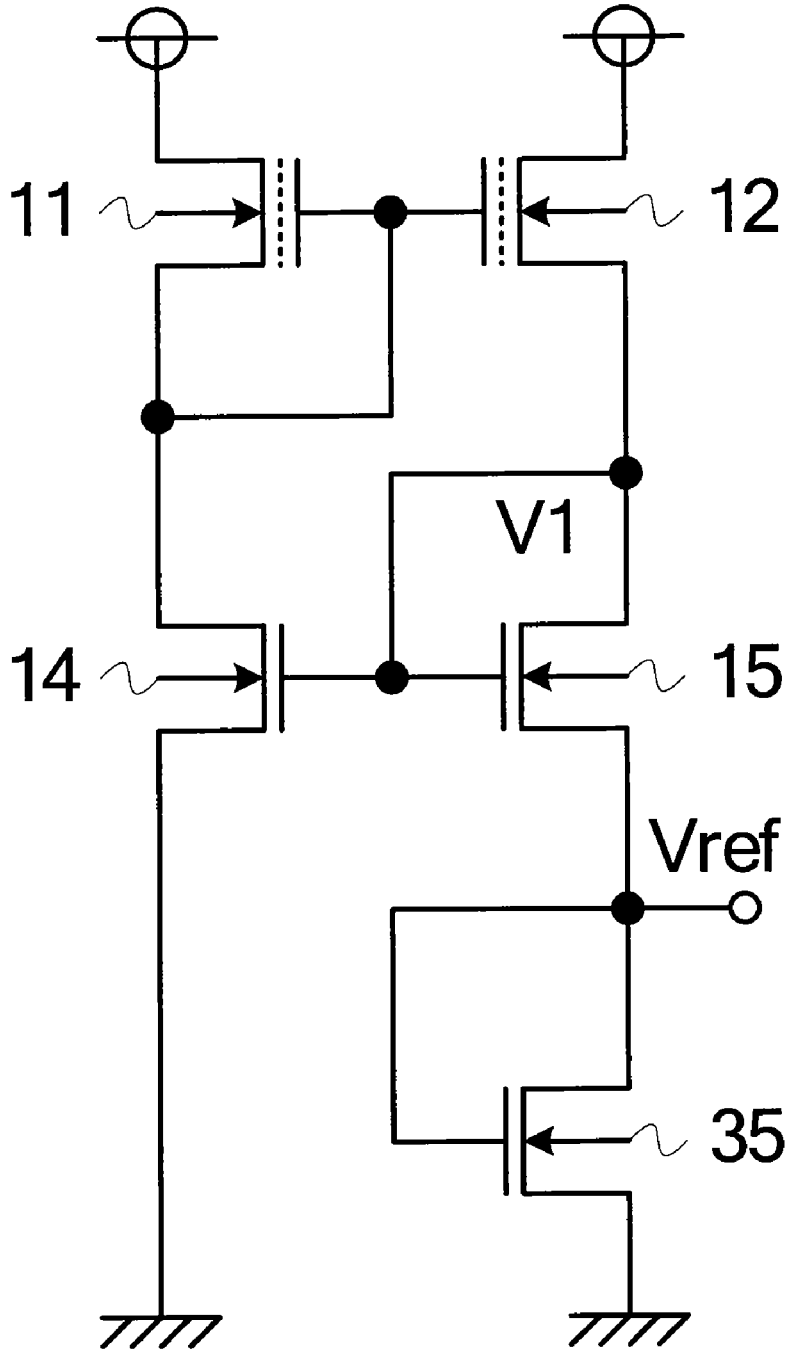
FIG. 7 is a circuit diagram illustrating a reference voltage circuit according to a second embodiment of the present invention.
Figure 8:
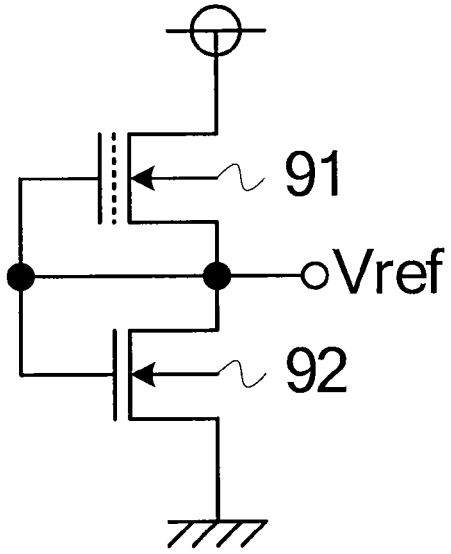
FIG. 8 Prior Art
FIG. 8 illustrates a conventional reference voltage circuit.
Figure 9:
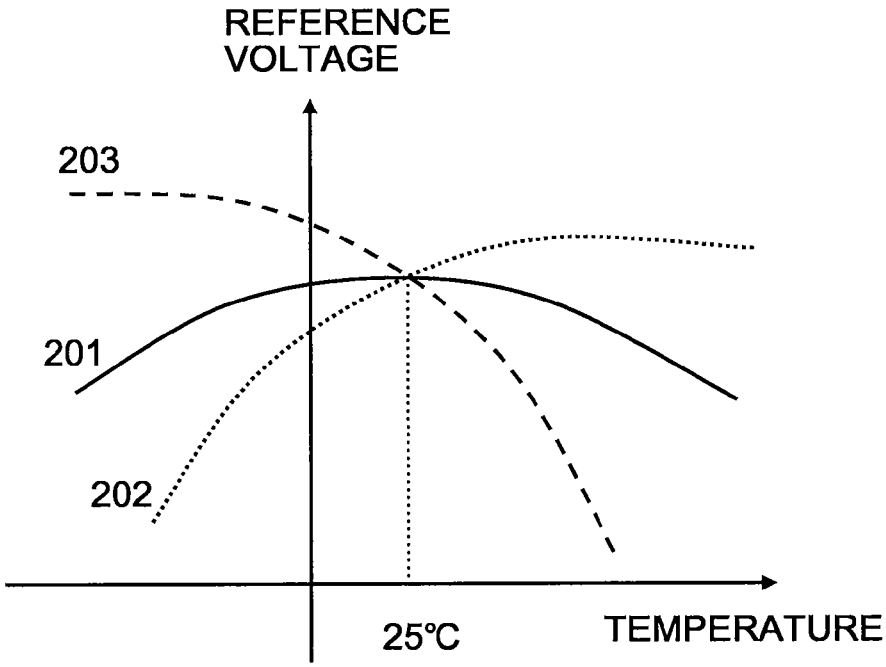
FIG. 9 Prior Art
FIG. 9 illustrates a conventional relationship between a reference voltage and a temperature.

Next, a reference voltage circuit according to a second embodiment of the present invention is described. FIG. 7 is a circuit diagram illustrating the reference voltage circuit according to the second embodiment of the prevent invention.

As a modification from FIG. 5, the gate of the E-type NMOS transistor 35 is connected to the reference voltage output terminal.

Next, an operation of the reference voltage circuit is described.

As in the case of the first embodiment, Expressions (1A), (2A), (3A), (9), and (10) hold.

Assume that a gate-source voltage of the E-type NMOS transistor 35 is denoted by VGE3, a threshold voltage thereof is denoted by VTE3, and a K-value thereof is denoted by KE3. Assume that the gate-source voltage of the E-type NMOS transistor 15 is denoted by VGE2, the threshold voltage thereof is denoted by VTE2, and the K-value thereof is denoted by KE2. In such a case, the D-type NMOS transistor 12 operates to maintain the voltage V1 constant and the same drain current flows into the E-type NMOS transistor 35 and the E-type NMOS transistor 15. Therefore, a drain current IE3 of the E-type NMOS transistor 35 and the drain current IE2 of the E-type NMOS transistor 15 are equal to each other, and hence the following Expression (31) holds. From Expression (31), the following Expression (32) holds.

$$IE3 = IE2 = KE3 \cdot (Vref - VTE3)^2 = KE2 \cdot (V1 - Vref - VTE2)^2 \tag{31}$$

$$Vref = \frac{\sqrt{\frac{KD1}{KE1}}\,|VTD1| + VTE1 - VTE2 + \sqrt{\frac{KE3}{KE2}}\,VTE3}{\left(1 + \sqrt{\frac{KE3}{KE2}}\right)} \tag{32}$$

The K-values of the D-type NMOS transistor 11, the E-type NMOS transistor 35, and the E-type NMOS transistors 14 and 15 are circuit-designed as appropriate so that the following Expression (33) holds in a case where $(KD1/KE1)^{1/2}=\beta$ and $(KE3/KE2)^{1/2}=\gamma$ to improve the temperature characteristic of the reference voltage Vref, that is, to suppress the change in tilt of the reference voltage Vref with respect to a temperature.

$$\frac{dVref}{dT_{T=25^\circ C.}} = \frac{1}{(1+\gamma)}\left(\frac{d\beta|VTD1|}{dT_{T=25^\circ C.}} + \frac{dVTE1}{dT_{T=25^\circ C.}} - \frac{dVTE2}{dT_{T=25^\circ C.}} + \frac{d\gamma VTE3}{dT_{T=25^\circ C.}}\right) = 0 \tag{33}$$

In this case, as in a case of the conventional circuit, the reference voltage Vref curves in a substantially quadric manner with respect to a temperature. The curve is expressed by the following Expression (34).

$$\frac{d^2 Vref}{dT^2} = \frac{1}{(1+\gamma)}\left(\frac{d^2\beta|VTD1|}{dT^2} + \frac{d^2 VTE1}{dT^2} - \frac{d^2 VTE2}{dT^2} + \frac{d^2\gamma VTE3}{dT^2}\right) \tag{34}$$

Therefore, as compared with the first embodiment, Expression (34) is obtained by further multiplying by $1/(1+\gamma)$, and hence the curve of the reference voltage Vref with respect to the temperature easily becomes smaller.

Note that, the E-type NMOS transistor 15 may be changed to a D-type NMOS transistor. In such a case, the reference voltage Vref easily increases, and hence the transistor between the reference voltage output terminal and the ground terminal is easily operated in the saturation region.

Third Embodiment

Figure 10:
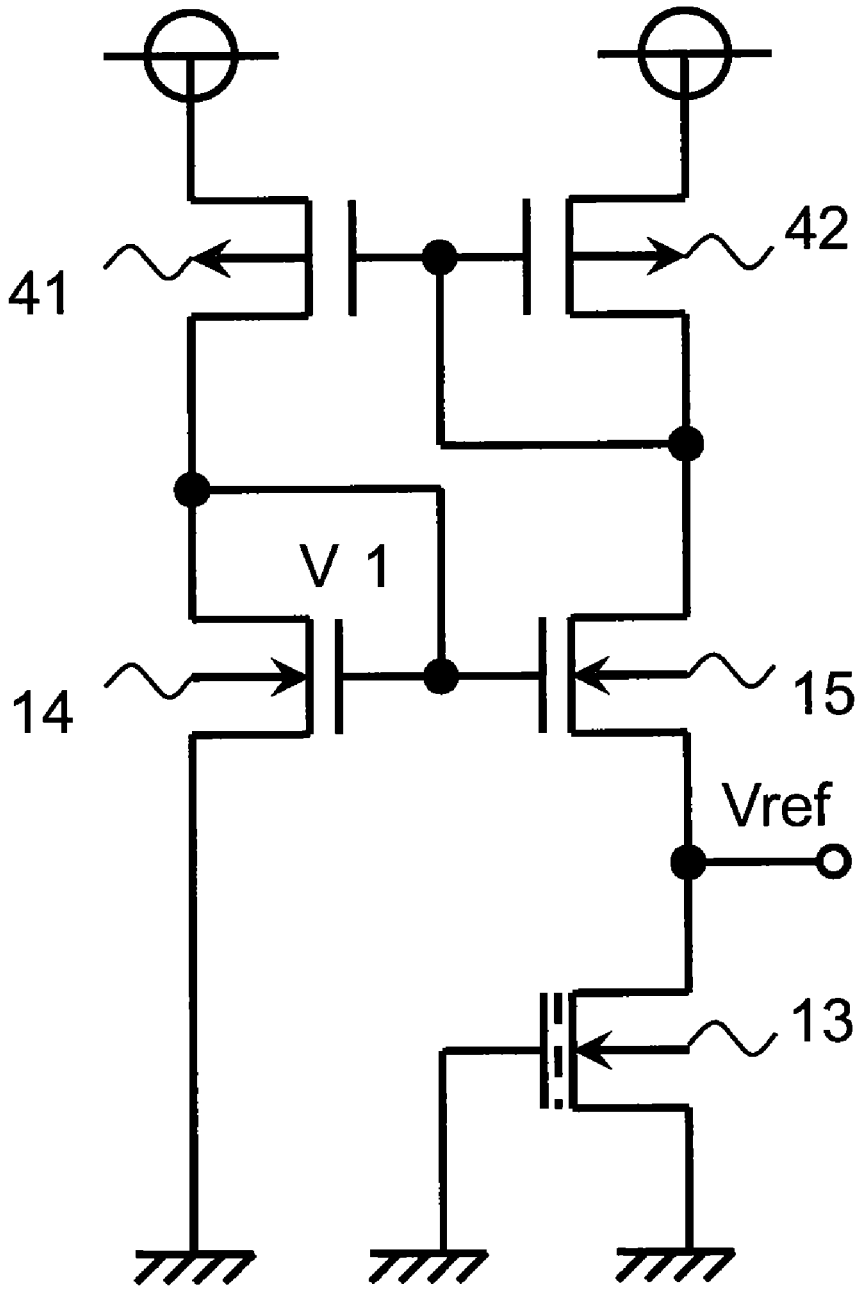
FIG. 10 is a circuit diagram illustrating a reference voltage circuit according to a third embodiment of the present invention.

Next, a reference voltage circuit according to a third embodiment of the present invention is described. FIG. 10 is a circuit diagram illustrating the reference voltage circuit according to the third embodiment of the prevent invention.

As compared with FIG. 1, the D-type NMOS transistors 11 and 12 are changed to E-type PMOS transistors 41 and 42. The E-type PMOS transistors 41 and 42 serve as a current mirror circuit. A gate and source of the E-type PMOS transistor 42 are connected to each other. The E-type NMOS transistors 14 and 15 serve as a current mirror circuit. The gate and drain of the E-type NMOS transistor 14 are connected to each other.

Next, an operation of the reference voltage circuit is described.

As in the case of the first embodiment, Expressions (3A), (11), and (12) hold.

The gate and drain of the E-type NMOS transistor 14 are connected to the gate of the E-type NMOS transistor 15, and hence VGE1=V1. The E-type PMOS transistors 41 and 42 serve as the current mirror circuit. Therefore, when the E-type PMOS transistors 41 and 42 are adjusted in threshold voltage and size so that the same drain current as in the D-type NMOS transistor 13 flows into the E-type NMOS transistor 14, the following Expression (35) holds. From Expression (35), Expression (36) holds.

$$IE1=ID2=KD2\cdot(|VTD2|)^2=KE1\cdot(V1-VTE1)^2 \quad (35)$$

$$V1=VTE1+(KD2/KE1)^{1/2}\cdot|VTD2| \quad (36)$$

From Expressions (12) and (36), the following Expression (37) holds.

$$Vref=VTE1-VTE2+\{(KD2/KE1)^{1/2}-(KD2/KE2)^{1/2}\}\cdot|VTD2| \quad (37)$$

Therefore, as compared with the first embodiment, in a case where a semiconductor silicon substrate is of a P-type, even when the D-type NMOS transistors 11 and 13 are manufactured to have the same threshold voltage and the same size, the D-type NMOS transistor 11 is back-gate biased. Thus, the same drain current is less likely to flow through the D-type NMOS transistors 11 and 13, and hence Expression (14) is less likely to hold. However, in the third embodiment, even in the case where the semiconductor silicon substrate is of the P-type, the influence of back gate bias is eliminated, and hence Expression (37) is satisfied.

Even in the cases of FIGS. 1 and 2, the D-type NMOS transistors 11 and 12 may be similarly changed to the E-type PMOS transistors.

The E-type NMOS transistor 15 may be changed to a D-type NMOS transistor. In such a case, the reference voltage Vref easily increases, and hence the transistor between the reference voltage output terminal and the ground terminal is easily operated in the saturation region.

What is claimed is:

1. A reference voltage circuit, comprising:
- a first depletion type NMOS transistor including:
  - a gate connected to a first terminal; and
  - a drain connected to a power supply terminal;
- a second depletion type NMOS transistor including:
  - a gate connected to the gate of the first depletion type NMOS transistor;
  - a source connected to a second terminal; and
  - a drain connected to the power supply terminal;
  - a first NMOS transistor including:
  - a drain connected to the first terminal; and
  - a source connected to a ground terminal;
  - a second NMOS transistor including:
  - a gate connected to a drain thereof, a gate of the first NMOS transistor, and the second terminal; and
  - a source connected to a reference voltage output terminal,
  - the second NMOS transistor having a threshold voltage lower than a threshold voltage of the first NMOS transistor; and
- a voltage generation circuit including a third depletion type NMOS transistor, for generating a reference voltage between the reference voltage output terminal and the ground terminal.

2. A reference voltage circuit according to claim 1, wherein:
- the first depletion type NMOS transistor further includes a source connected to the gate thereof; and
- the third depletion type NMOS transistor included in the voltage generation circuit includes:
  - a gate connected to the ground terminal;
  - a source connected to the ground terminal; and
  - a drain connected to the reference voltage output terminal.

3. A reference voltage circuit according to claim 1, wherein:
- the first depletion type NMOS transistor further includes a source connected to the gate thereof;
- the voltage generation circuit further comprises:
  - a third enhancement type NMOS transistor including:
    - a source connected to the ground terminal; and
    - a drain connected to the reference voltage output terminal; and
  - a fourth enhancement type NMOS transistor including:
    - a gate connected to a drain thereof and a gate of the third enhancement type NMOS transistor; and
    - a source connected to the ground terminal; and
- the third depletion type NMOS transistor includes:
  - a gate connected to a source thereof and the drain of the fourth enhancement type NMOS transistor; and
  - a drain connected to the power supply terminal.

4. A reference voltage circuit according to claim 1, wherein:
- the first depletion type NMOS transistor further includes a source connected to the gate thereof;
- the voltage generation circuit further comprises:
  - a third enhancement type NMOS transistor including:
    - a source connected to the ground terminal; and
    - a drain connected to the reference voltage output terminal; and
  - a fourth enhancement type NMOS transistor including:
    - a gate connected to a drain thereof and a gate of the third enhancement type NMOS transistor; and
    - a source connected to the ground terminal; and
- the third depletion type NMOS transistor includes:
  - a gate connected to the gate of the first depletion type NMOS transistor;
  - a source connected to the drain of the fourth enhancement type NMOS transistor; and
  - a drain connected to the power supply terminal.

5. A reference voltage circuit according to claim 1, wherein:
- the voltage generation circuit further comprises:
  - a third enhancement type NMOS transistor including:
    - a source connected to the ground terminal; and
    - a drain connected to the reference voltage output terminal; and
  - a fourth enhancement type NMOS transistor including:
    - a gate connected to a drain thereof and a gate of the third enhancement type NMOS transistor; and
    - a source connected to the ground terminal; and
- the third depletion type NMOS transistor includes:
  - a gate connected to a source thereof, the gate of the first depletion type NMOS transistor, and the drain of the fourth enhancement type NMOS transistor; and
  - a drain connected to the power supply terminal.

6. A reference voltage circuit according to claim 1, wherein each of the first NMOS transistor and the second NMOS transistor is of an enhancement type.

7. A reference voltage circuit according to claim 1, wherein:
- the first NMOS transistor is of an enhancement type; and
- the second NMOS transistor is of a depletion type.

8. A reference voltage circuit, comprising:
- a first enhancement type PMOS transistor including:
  - a source connected to a power supply terminal; and
  - a drain connected to a first terminal;

a second enhancement type PMOS transistor including:
a gate connected to a drain thereof, a gate of the first enhancement type PMOS transistor, and a second terminal; and
a source connected to the power supply terminal;
a first NMOS transistor including:
a gate connected to a drain thereof and the first terminal; and
a source connected to a ground terminal;
a second NMOS transistor including:
a gate connected to the gate of the first NMOS transistor;
a drain connected to the second terminal; and
a source connected to a reference voltage output terminal,
the second NMOS transistor having a threshold voltage lower than a threshold voltage of the first NMOS transistor; and
a voltage generation circuit including a third depletion type NMOS transistor, for generating a reference voltage between the reference voltage output terminal and the ground terminal.

9. A reference voltage circuit according to claim 8, wherein the third depletion type NMOS transistor included in the voltage generation circuit includes:
a gate connected to the ground terminal;
a source connected to the ground terminal; and
a drain connected to the reference voltage output terminal.

10. A reference voltage circuit according to claim 8, wherein:
the voltage generation circuit further comprises:
a third enhancement type NMOS transistor including:
a source connected to the ground terminal; and
a drain connected to the reference voltage output terminal; and
a fourth enhancement type NMOS transistor including:
a gate connected to a drain thereof and a gate of the third enhancement type NMOS transistor; and
a source connected to the ground terminal; and
the third depletion type NMOS transistor includes:
a gate connected to a source thereof and the drain of the fourth enhancement type NMOS transistor; and
a drain connected to the power supply terminal.

11. A reference voltage circuit according to claim 8, wherein each of the first NMOS transistor and the second NMOS transistor is of an enhancement type.

12. A reference voltage circuit according to claim 8, wherein:
the first NMOS transistor is of an enhancement type; and
the second NMOS transistor is of a depletion type.

13. A reference voltage circuit, comprising:
a first depletion type NMOS transistor including:
a gate connected to a source thereof a first terminal; and
a drain connected to a power supply terminal;
a second depletion type NMOS transistor including:
a gate connected to the gate of the first depletion type NMOS transistor;
a source connected to a second terminal; and
a drain connected to the power supply terminal;
a first NMOS transistor including:
a drain connected to the first terminal; and
a source connected to a ground terminal;
a second NMOS transistor including:
a gate connected to a drain thereof, a gate of the first NMOS transistor, and the second terminal; and
a source connected to a reference voltage output terminal,
the second NMOS transistor having a threshold voltage lower than a threshold voltage of the first NMOS transistor; and
a voltage generation circuit including a fifth enhancement type NMOS transistor, for generating a reference voltage between the reference voltage output terminal and the ground terminal.

14. A reference voltage circuit according to claim 13, wherein the fifth enhancement type NMOS transistor includes:
a gate connected to the gate of the second NMOS transistor;
a source connected to the ground terminal; and
a drain connected to the reference voltage output terminal.

15. A reference voltage circuit according to claim 14, further comprising a sixth enhancement type NMOS transistor including:
a gate connected to the gate of the fifth enhancement type NMOS transistor;
a source connected to the ground terminal; and
a drain connected to the source of the first NMOS transistor.

16. A reference voltage circuit according to claim 13, wherein the fifth enhancement type NMOS transistor includes:
a gate connected to the reference voltage output terminal;
a drain connected to the reference voltage output terminal; and
a source connected to the ground terminal.

17. A reference voltage circuit according to claim 13, wherein each of the first NMOS transistor and the second NMOS transistor is of an enhancement type.

18. A reference voltage circuit according to claim 13, wherein:
the first NMOS transistor is of an enhancement type; and
the second NMOS transistor is of a depletion type.

* * * * *